US006019584A

United States Patent [19]

Uppal

[11] Patent Number: 6,019,584

[45] Date of Patent: Feb. 1, 2000

[54] COUPLING FOR USE WITH A GEROTOR DEVICE

[75] Inventor: Sohan L. Uppal, Bloomington, Minn.

[73] Assignee: Eaton Corporation, Cleveland, Ohio

[21] Appl. No.: 08/862,887

[22] Filed: May 23, 1997

[51] Int. Cl.[7] ..... F01C 1/10

[52] U.S. Cl. ..... 418/61.3

[58] Field of Search ..... 418/61.3; 60/384, 60/386; 91/375 A, 375 R, 467; 137/625.68, 625.69; 180/441

[56] References Cited

U.S. PATENT DOCUMENTS

| | | | |
|---|---|---|---|
| 1,284,650 | 11/1918 | Gollings | 418/153 |
| 3,087,436 | 4/1963 | Dettloff et al. | 418/61.3 |
| 3,270,682 | 9/1966 | Charlson | 418/61.3 |
| 3,782,866 | 1/1974 | McDermott | 418/61.3 |
| 4,171,938 | 10/1979 | Pahl | 418/61.3 |
| 4,359,866 | 11/1982 | Tischer | 418/61.3 |
| 4,439,119 | 3/1984 | Petersen et al. | 418/61.3 |
| 5,056,994 | 10/1991 | Eisenmann et al. | 418/61.3 |
| 5,100,310 | 3/1992 | Uppal | 418/61.3 |

FOREIGN PATENT DOCUMENTS

| | | | |
|---|---|---|---|
| 3327772 | 2/1985 | Germany | 418/61.3 |

*Primary Examiner*—John J. Vrablik
*Attorney, Agent, or Firm*—L. J. Kasper

[57] ABSTRACT

A coupling arrangement (63;107;229) for use in a fluid pressure device including a gerotor gear set (15;83;205). The gerotor gear set includes an orbiting and rotating star (21;95;209). In a motor embodiment (FIGS. 1–4 and FIG. 6), the coupling (63;229) transmits the orbital and rotational movement of the star (21;209) to an output shaft (29;203). In a steering unit embodiment (FIG. 5) the orbital and rotational movement of the star (95) is transmitted as rotational follow-up movement to a sleeve valve (101). In either case, the invention eliminates the need for the conventional solid dogbone arrangement, thus making the device much less expensive and more compact, and giving the designer greater flexibility with regard to various options, such as the provision of thru-shaft capability for a motor.

15 Claims, 5 Drawing Sheets

COUPLING FOR USE WITH A GEROTOR DEVICE

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to a fluid displacement mechanism of the gerotor type, and more particularly, to an improved coupling for use therewith.

Gerotor fluid displacement mechanisms (gear sets) have become quite popular, and their commercial use very widespread. Gerotor gear sets are used typically as the fluid displacement mechanism in low-speed, high-torque hydraulic motors, and the present invention will be described primarily in connection therewith. However, those skilled in the art will understand that the use of the invention is not so limited, and it may be applied advantageously to other devices utilizing a gerotor as the fluid displacement mechanism. For example, a gerotor is used as the fluid meter in a full fluid linked hydrostatic power steering unit, an example of which is illustrated and described in U.S. Pat. No. Re. 25,291, assigned to the assignee of the present invention, and incorporated herein by reference.

Most low-speed, high-torque gerotor motors made commercially are of either the "spool valve" type, illustrated and described in U.S. Pat. No. 4,171,938, or the "disc valve" type, illustrated and described in U.S. Pat. No. 4,343,600, both of which are assigned to the assignee of the present invention, and incorporated herein by reference. In either case, the star member of the gerotor gear set orbits and rotates within a stationary ring member, such orbital and rotational movement providing the low-speed, high-torque output, as is well known to those skilled in the art.

Unfortunately, the orbital and rotational movement of the gerotor star, in and of itself, is generally not useful, but must first be translated into pure rotational movement of a member, such as a motor output shaft. In the case of a hydrostatic power steering unit, the orbital and rotational movement of the gerotor star must be translated into rotational movement of a follow-up valve member, as is well known in the art. For as long as low-speed, high-torque gerotor motors have been known, the typical, commercial product has utilized a "dogbone" shaft to transmit the orbital and rotational movement of the star into rotation of the output shaft. Such dogbone shafts are illustrated and described in the above-incorporated patents. The conventional dogbone shaft is a solid shaft, and has a set of external, crowned splines at each end, one set being in splined engagement with straight internal splines defined by the gerotor star, and the other set of crowned splines being in splined engagement with straight internal splines defined by the output shaft. The crown of the external splines on the dogbone shaft permits it to "wobble", with the end engaging the star orbiting and rotating, while the end engaging the output shaft merely rotates.

Although the dogbone shaft and spline arrangement described above has been quite successful commercially, in terms of general motor performance, durability, etc., the arrangement does have a number of disadvantages, which have traditionally been considered somewhat unavoidable. The need to form (hob, roll, cold forge, etc.) four sets of splines per motor (with two being crowned, and one typically disposed in the bottom of a blind hole), has added substantially to the overall cost of the motor. As an additional item of cost, the star needs to be heat treated, only because of the splines, and such heat treating frequently results in distortion of the star. This potential for distortion has, until the time of the present invention, deterred those working in the gerotor art from using "net shape" powdered metal stars in their gerotor gear sets.

In addition, the rubbing action between the internal and external splines, as the dogbone shaft wobbles, generates a substantial amount of heat within the motor, which is typically transferred to the hydraulic fluid, thus increasing the need to cool the fluid, such as by means of a heat exchanger disposed somewhere in the hydraulic circuit. An increased heat load in the hydraulic circuit always adds to the overall cost of the circuit, or of the vehicle, or of the piece of equipment using the circuit.

A further disadvantage of the prior art dogbone and spline arrangement is that, in many motors, the need to reduce the wobble angle of the dogbone, for reasons well known to those skilled in the art, has resulted in a dogbone shaft having a length which makes the motor much larger in overall size than is really necessary, thus adding further to the weight and cost of the motor. In some vehicle applications, there is insufficient room for the gerotor motor which is needed, in terms of torque capacity, for the particular application.

The conventional internal splines in the output shaft/spool valve assembly results in the spool valve either being larger in diameter, thus increasing the possibility of leakage, or being thinner radially. In the latter case, under high pressure, the spool valve compresses radially, again resulting in increased leakage and loss of volumetric efficiency. In either case, the internally splined output shaft limits the potential performance of the device.

Finally, there are many potential applications for gerotor motors of the "thru-shaft" type, i.e., having an output shaft extending out of each end of the motor, with both being powered by the same gerotor gear set. It does not appear that, as of the filing of the present application, there are any commercially available thru-shaft gerotor motors. One of the possible reasons is the difficulty of transmitting orbital and rotational movement of the gerotor star into rotational movement of two oppositely disposed output shafts, without the resulting motor becoming so large and expensive as not to be economically feasible.

BRIEF SUMMARY OF THE INVENTION

Accordingly, it is an object of the present invention to provide an improved gerotor fluid displacement mechanism, and coupling arrangement therefor, which substantially overcomes the above described problems of the prior art dogbone and spline arrangement.

It is a more specific object of the present invention to provide an improved arrangement for transmitting movement between an orbiting and rotating gerotor star and a rotating shaft (or "sleeve"), wherein the arrangement requires much less machining than the prior art, and therefore, is much less expensive, while eliminating the need to heat treat certain of the parts.

Further, it is an object of the present invention to provide such an improved coupling arrangement which generates much less heat during operation, thus reducing the cooling load on the circuit, and is much more compact than in the prior art, such that the overall size and weight of the motor or other device can be substantially reduced.

It is an additional object of the present invention to provide an improved coupling arrangement, whereby items such as internal splines in an output shaft and an externally splined, wobbling dogbone shaft don't dictate the size of elements such as the spool valve of a motor or the spool and sleeve valves of a power steering unit.

Finally, it is an object of the present invention to provide such an improved coupling arrangement which makes it economically feasible to provide a thru-shaft gerotor motor, of the type in which the star orbits and rotates within a stationary gerotor ring member.

The above and other objects of the invention are accomplished by the provision of a rotary fluid pressure device of the type including housing means defining a fluid inlet port and a fluid outlet port, and fluid energy-translating displacement means associated with the housing means, and including an internally toothed ring member and an externally toothed star member eccentrically disposed within the ring member, and having orbital and rotational movement relative to the ring member. The teeth of the ring member and the star member interengage to define expanding and contracting fluid volume chambers in response to the orbital and rotational movement. Valve means cooperates with the housing means to provide fluid communication between inlet port and the expanding fluid volume chambers, and between the contracting fluid volume chambers and the outlet port. A shaft means is rotatably supported relative to the housing means, and there is means for transmitting the orbital and rotational movement of the star member into rotational movement of the shaft means.

The improved rotary fluid pressure device is characterized by the means for transmitting the orbital and rotational movement comprising the shaft means including a terminal portion disposed adjacent the star member. A generally cylindrical hollow coupling member is associated with the terminal portion of the shaft means, the coupling member including a star end and a shaft end, and having its axis at a wobble angle relative to the axis of the shaft means. A first means couples the star end of the coupling member to the star member to orbit and rotate therewith. A second means couples the shaft end of the coupling member to the shaft means to transmit rotational movement of the shaft end of the coupling member to the shaft means.

BRIEF DESCRIPTION OF THE DRAWINGS

FIG. 6 is an axial cross-section of a different type of low speed, high torque gerotor motor, utilizing an alternative embodiment of the coupling arrangement of the present invention.

DETAILED DESCRIPTION OF THE PREFERRED EMBODIMENT

Figure 1:
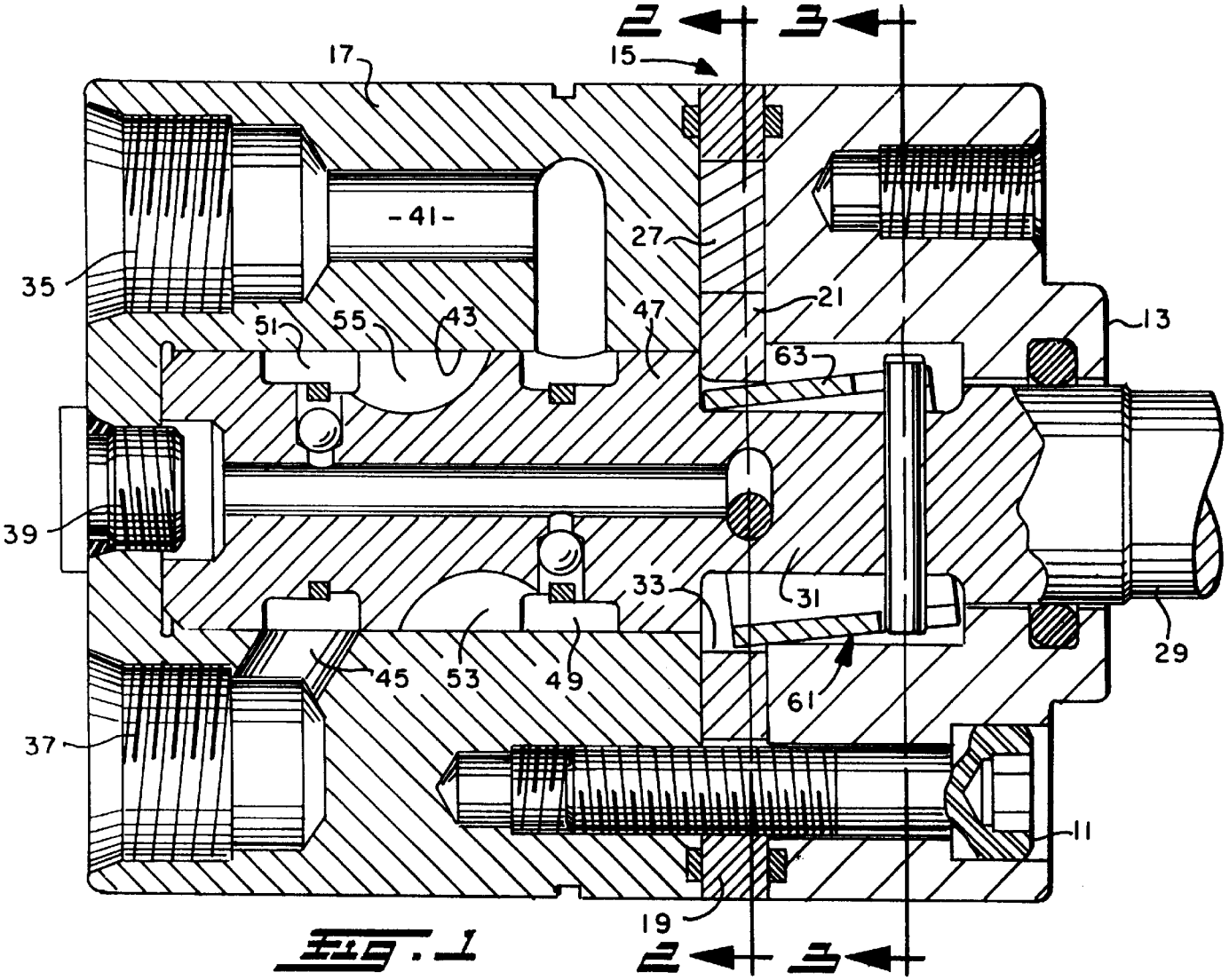
FIG. 1 is an axial cross-section of a low-speed, high-torque gerotor motor made in accordance with the present invention.

Referring now to the drawings, which are not intended to limit the invention, FIG. 1 illustrates a low-speed, high-torque gerotor motor made in accordance with the present invention, and which is especially adapted for use as a "mini-motor", i.e., one which is relatively small in overall dimensions. The gerotor motor shown in FIG. 1 is in many ways similar to, and incorporates many of the features of U.S. Pat. No. 5,100,310, assigned to the assignee of the present invention, and incorporated herein by reference. The gerotor motor shown in FIG. 1 comprises a plurality of sections secured together, such as by a plurality of bolts 11, only one of which is shown in each of FIGS. 1 and 2. The motor includes a shaft support casing 13, a gerotor displacement mechanism 15, and a valve housing section 17.

The gerotor mechanism 15 is well known in the art, is shown and described in U.S. Pat. No. 4,533,302, assigned to the assignee of the present invention and incorporated herein, and will be described only briefly herein. More specifically, the gerotor mechanism 15 comprises an internally toothed ring member 19 and an externally toothed star member 21, eccentrically disposed within the ring member 19. The star member 21, in the subject embodiment, orbits and rotates within the ring member 19, and this orbital and rotational movement defines a plurality of expanding fluid volume chambers 23, and a plurality of contracting fluid volume chambers 25. Although not an essential feature of the present invention, it is considered preferable for the ring member 19 to include a plurality of generally cylindrical rollers 27, which comprise the internal teeth of the ring member 19.

Referring still primarily to FIG. 1, the gerotor motor includes an output shaft 29, rotatably supported within the shaft support casing 13. It should be clearly understood that if the device is to be used as a pump, the shaft 29 can instead serve as an input shaft, and references herein, and in the appended claims, to an "output shaft" will be understood to mean and include use of the shaft as either an input shaft or an output shaft. Formed integrally with the output shaft 29 is a reduced diameter shaft portion 31, referred to hereinafter as a "terminal" portion of the output shaft 29 because of its location immediately adjacent the gerotor mechanism 15, and the fact that the reduced diameter portion 31 extends axially through a central opening 33 defined by the star member 21. It should be clearly understood that the use of the term "terminal" in reference to the portion 31 does not mean or imply that the portion 31 has an end adjacent the star 21, and in fact, it is a feature of the invention that the shaft 29 is able to extend through the star member 21, uninterrupted.

Referring still primarily to FIG. 1, the valve housing section 17 defines an inlet port 35, an outlet port 37, and a case drain port 39. The valve housing 17 defines a pressure passage 41 extending from the inlet port 35 to a valve bore 43 defined by the housing section 17. Similarly, the valve housing section 17 defines a return passage 45 extending from the valve bore 43 to the outlet port 37.

Rotatably disposed within the valve bore 43 is a spool valve member 47. As is generally well known to those skilled in the art, the spool valve member 47 defines a forward circumferential groove 49 in communication with the inlet port 35 by means of the pressure passage 41, and a rearward circumferential groove 51, in fluid communication with the outlet port 37 by means of the return passage 45. The spool valve member 47 further defines a plurality of forward axial slots 53, in communication with the forward groove 49, and a plurality of rearward axial slots 55 in communication with the rearward groove 51. The axial slots 53 and 55 are arranged in an alternating, interdigitated pattern about the outer periphery of the spool valve 47. As is well known to those skilled in the art, the valve housing section 17 defines a plurality of commutation passages (not shown herein), each of which is in open communication with one of the volume chambers 23 or 25, and each of which is in commutating fluid communication with the slots 53 and 55, as the spool valve 47 rotates. Therefore, in the subject embodiment, because there are five of the volume chambers 23 and 25, there are five of the commutation passages, four of the forward axial slots 53, and four of the rearward axial slots 55, for reasons which are well known to those skilled in the art.

In accordance with one aspect of the present invention, the spool valve member 47 is formed integrally with the reduced diameter portion 31 which, as noted previously, is formed integrally with the output shaft 29. In other words, the output shaft 29 and the spool valve 47 comprise a single, integral part. However, it should be understood by those skilled in the art that such is merely the preferred embodiment, not an essential feature of the invention. In other words, the present invention makes it possible for the output shaft 29 and spool valve 47 to comprise a single, integral part, but such is not required to practice the present invention.

Referring now to all of FIGS. 1–4, a coupling arrangement, generally designated 61, will be described. The reduced diameter portion 31 is surrounded by a hollow, generally cylindrical coupling member 63, which preferably may comprise a fairly simple and inexpensive member, such as a tubular member cut to length, or a die cast member, etc. The coupling member 63 defines, at its rearward or "star" end 63*a*, a pair of notches 65 (see FIG. 2), disposed diametrically opposite each other. Similarly, the coupling member 63 defines, at its forward or "shaft" end 63*b*, a pair of notches 67, also disposed diametrically opposite each other. The pairs of notches 65 and 67 would typically be identical, and will be described further subsequently.

Figure 2:
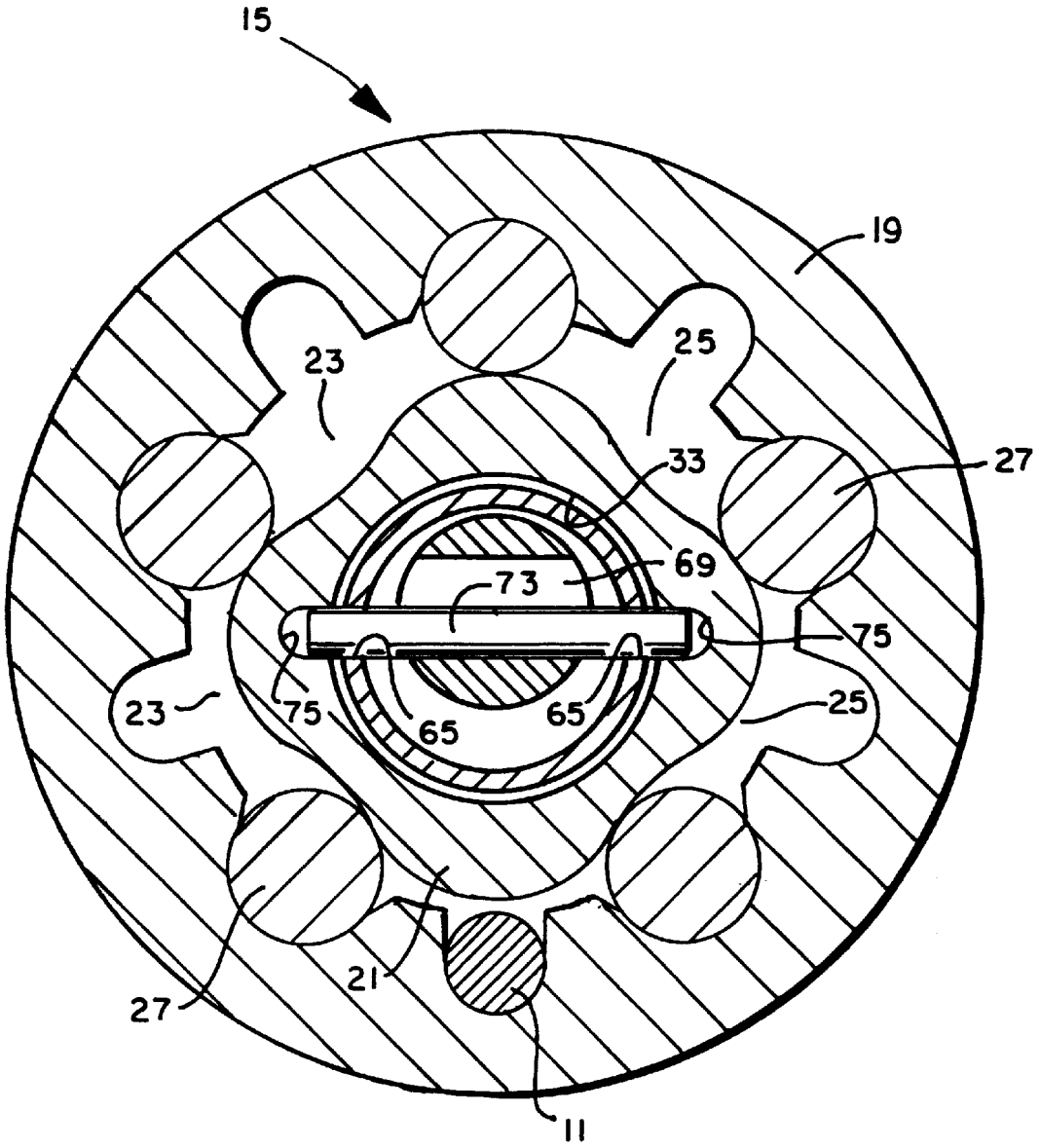
FIG. 2 is a transverse cross-section taken on line 2—2 of FIG. 1.
Figure 3:
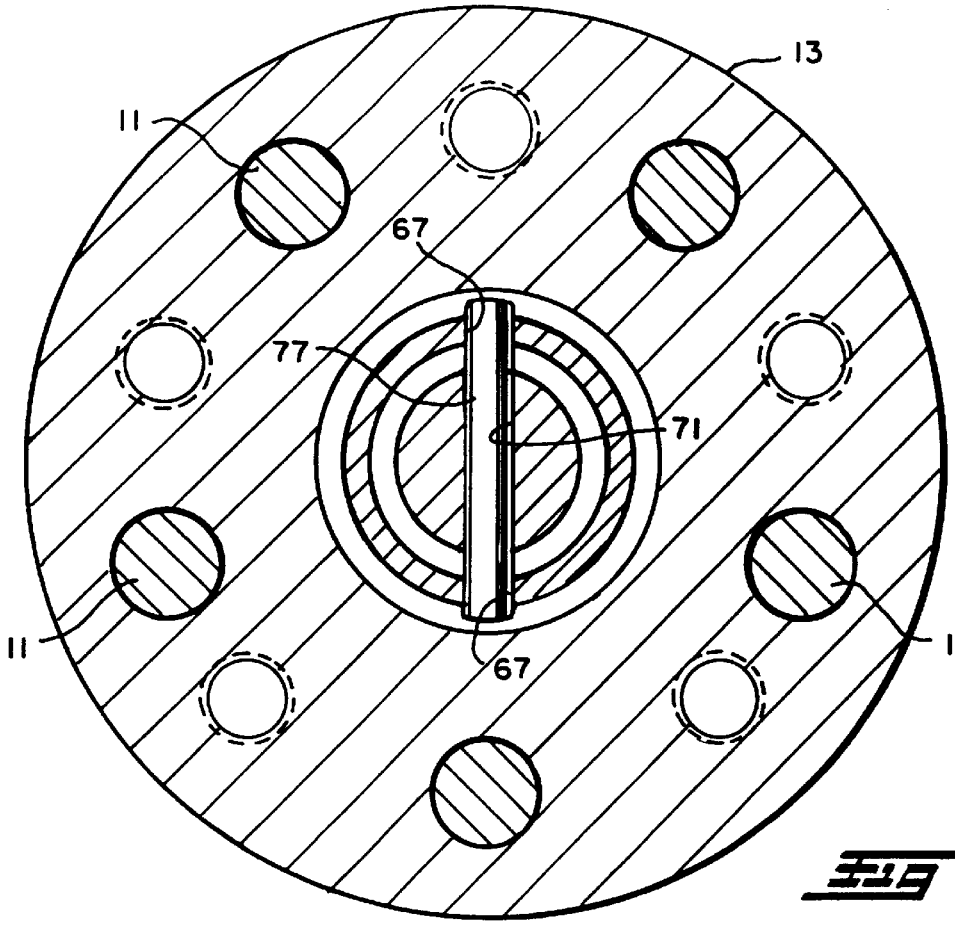
FIG. 3 is a transverse cross-section taken on line 3—3 of FIG. 1, and on the same scale as FIG. 2.
Figure 4:
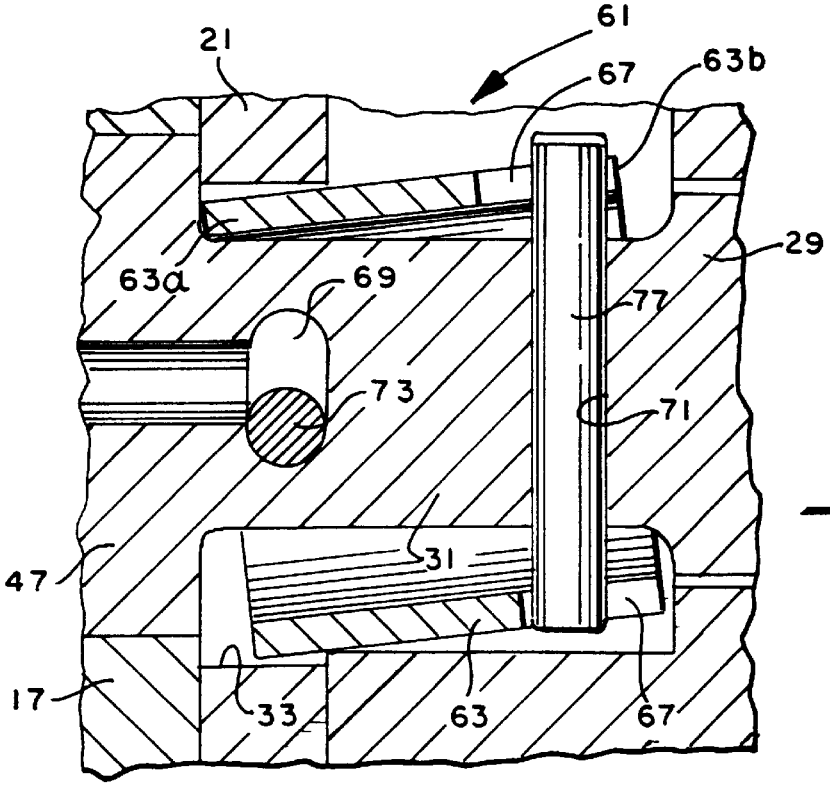
FIG. 4 is an enlarged, fragmentary, axial cross section, similar to FIG. 1, illustrating in greater detail one aspect of the present invention.

As may best be seen in FIGS. 2 and 4, the reduced diameter portion 31 defines a diametrally elongated opening 69, and as may best be seen in FIGS. 3 and 4, the reduced diameter portion 31 defines a diametrally extending bore 71. Disposed within the opening 69 is an elongated pin 73, which is in a close fit relationship within both the opening 69 and the notches 65, although it will become apparent that the pin 73 should never engage the adjacent surface of the opening 69. The ends of the elongated pin 73 are received fixedly in a pair of pin openings 75 defined by the star member 21. In other words, the purpose of the opening 69 is simply to make is possible to use only a single pin 73 to connect the coupling member 63 to the star 21. In a similar manner, disposed within the bore 71 is an elongated pin 77, which is in a close fit relationship within both the bore 71 and the notches 67. The ends of the elongated pin 77, unlike the pin 73, do not extend far enough beyond the coupling member 63 to be in engagement with any other structure. Also, the pin 77 does engage the surface of the bore 71, whereby the pin 77 may transmit torque to the shaft 29.

Although, in the subject embodiment, the pins 73 and 77 comprise cylindrical members, it will become apparent, from a further reading and understanding of the present specification, that the pins 73 and 77 may have various other shapes and configurations, without deviating from the teachings of the invention. By way of example only, the pins 73 and 77 may be generally square in cross section, and still serve the purpose of the invention, although they are preferably cylindrical, thus facilitating machining of the opening 69 and bore 71.

By viewing FIGS. 2–4, it may be seen that, as the star 21 orbits and rotates, the star end 63*a* of the coupling member 63 also orbits and rotates, because of the pin 73 preventing relative rotation between the star 21 and the star end 63*a* of the coupling. The elongated opening 69 permits the star 21 and the star end 63*a* to orbit relative to the reduced diameter portion 31. The coupling member 63 transmits the orbital and rotational movement of the star end 63*a* into pure rotation of the shaft end 63*b*. The close fit of the connection of the pin 77 to the bore 71 and the notches 67 results in the rotational movement of the shaft end 63*b* being translated into rotation of the portion 31, as well as the output shaft 29 and spool valve 47. Preferably, the notches 65 are elongated (as the notches 67 are shown to be in FIGS. 1 and 4), to permit "wobbling" of the coupling member 63, relative to the axis of the shaft 29, the portion 31, and the spool valve 47.

Those skilled in the art will understand, from viewing FIG. 1, that the present invention makes it feasible, and fairly simple to provide a through-shaft motor. The key is having a shaft which extends through the gerotor star, and prior to the present invention, it was not known how, in a feasible manner, to couple an orbiting and rotating gerotor star to a shaft extending through the star. However, with the present invention, an output shaft disposed opposite of the shaft 29 could be provided integral with the spool valve 47, and supported by a portion of the valve housing section 17, at the left end thereof in FIG. 1.

It will be understood by those skilled in the art, upon careful analysis of the present invention, that, theoretically, the portion of the reduced diameter portion 31 disposed between the opening 69 and the bore 71 could be eliminated. The result would be that the orbital and rotational movement of the star 21 would still be translated into purely rotary motion of the output shaft 29, which is the essential feature of the invention. However, by making the output shaft 29 integral with the spool valve 47, by means of the reduced diameter portion 31, the coupling arrangement 61 effectively drives both the output shaft 29 and the spool valve 47. Also, it would be possible to replace each of the elongated pins 73 and 77 with two separate, shorter pins. For example, the pin 73 could be replaced by two shorter pins, each of which would have one end disposed within the opening 75 and the other end engaging the notch 65, but without a portion passing through the opening 69 (which would therefore become unnecessary). The pin 77 could be replaced by two shorter pins, each of which would have an inner end received in a short bore in the reduced portion 31 and an outer end engaging the notch 67.

FIG. 5 EMBODIMENT

Figure 5:
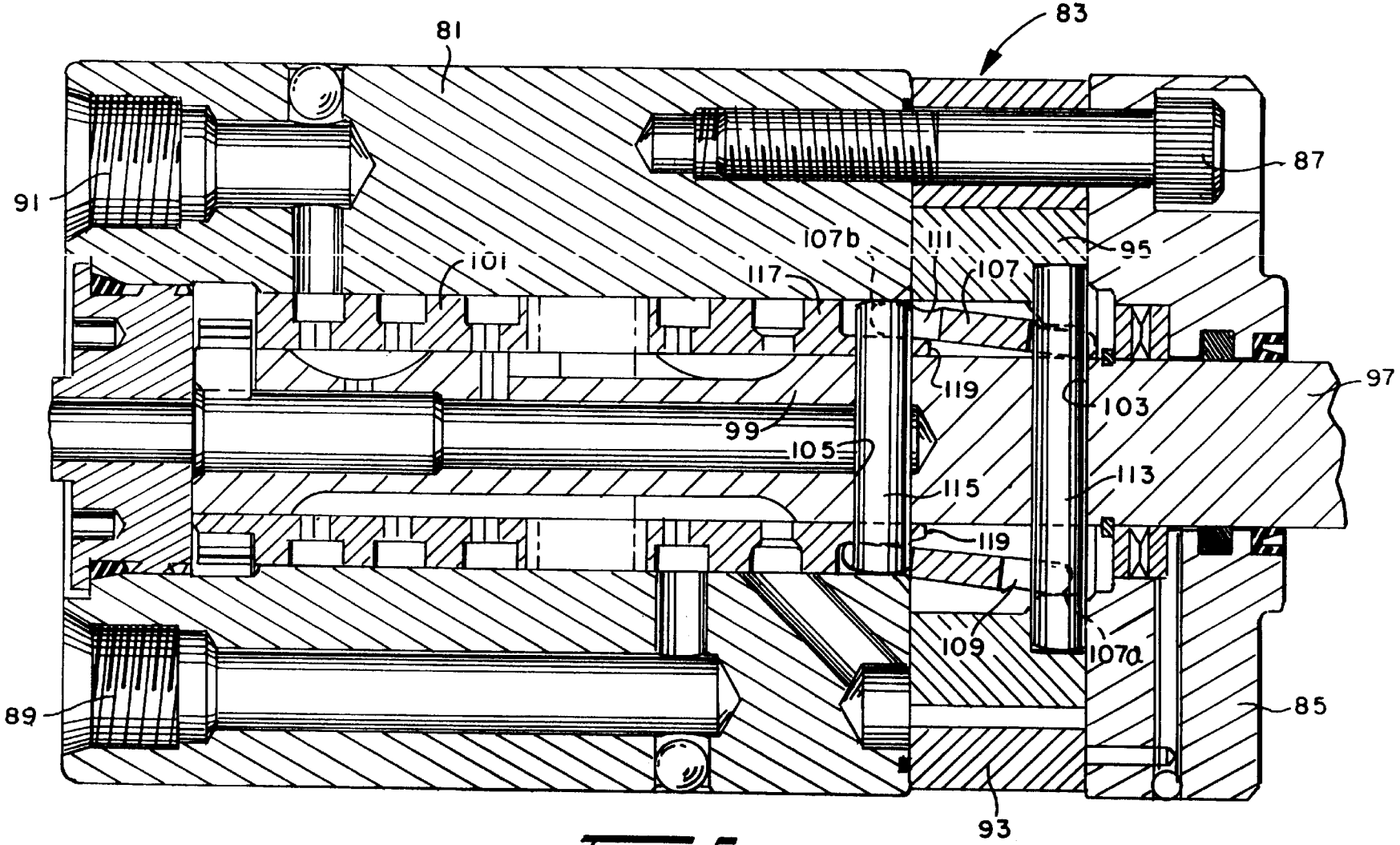
FIG. 5 is an axial cross-section of a full fluid linked, hydrostatic power steering unit utilizing the coupling arrangement of the present invention.
Figure 5:
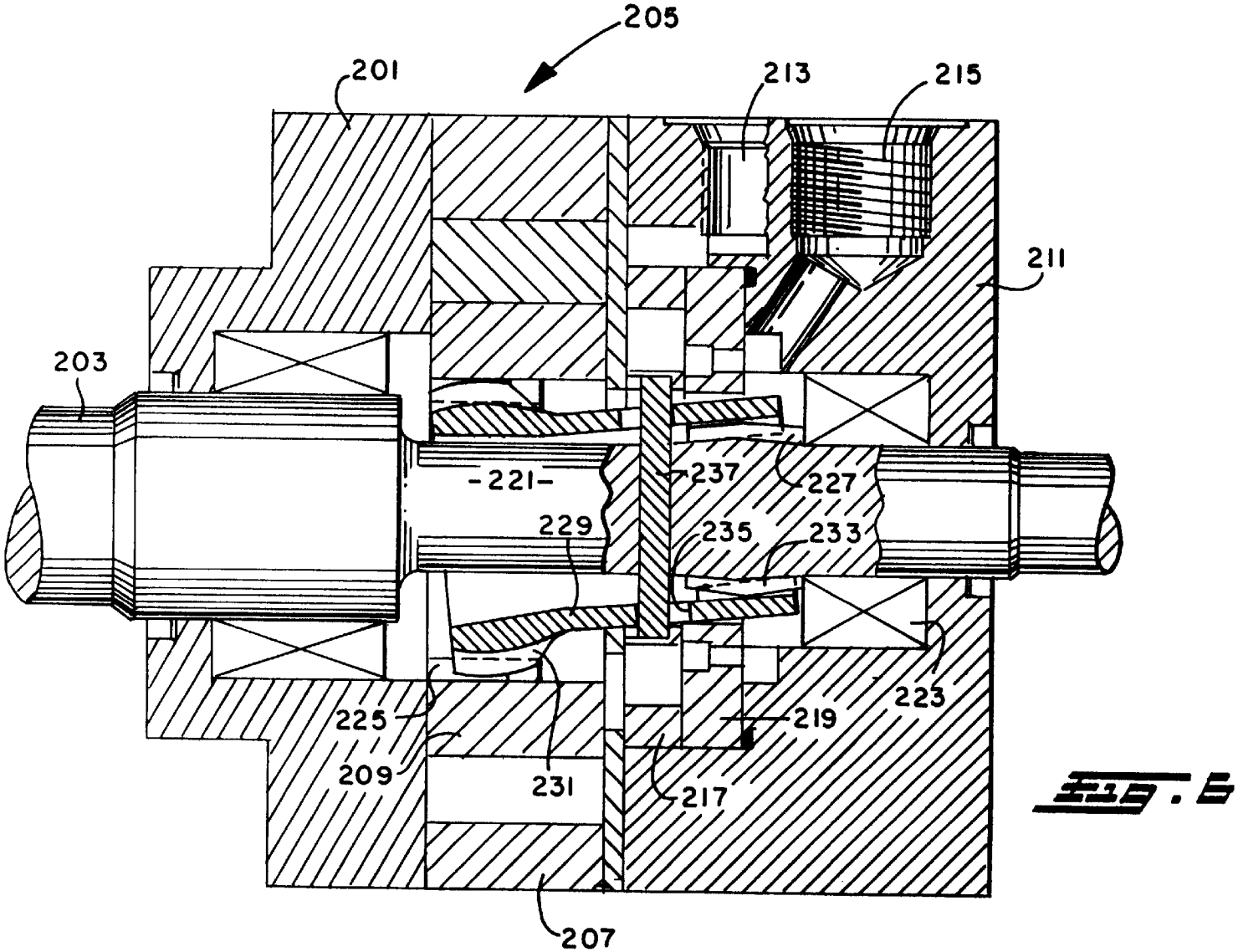

Referring now primarily to FIG. 5, there is illustrated an alternative embodiment of the present invention, i.e., the present invention being utilized not to transmit motion to an output shaft of a gerotor motor, but instead, to transmit follow up movement from a gerotor star to a follow up valve member in a full fluid linked, hydrostatic power steering device, the follow-up valve member being considered a "shaft" for purposes of the appended claims.

The steering device or steering control unit (SCU) may be made in accordance with the general teachings of co-pending application U.S. Ser. No. 728,229, filed Oct. 10, 1996 for a "STEERING CONTROL UNIT", in the name of Sohan L. Uppal, and incorporated herein by reference. Thus, the SCU shown in FIG. 5 will be described only briefly herein. The SCU includes a valve housing section 81, a gerotor displacement mechanism, generally designated 83, and a forward end cap 85, all of which are held together in tight sealing engagement by means of a plurality of bolts 87. The valve housing section 81 defines a fluid inlet port 89 and a fluid return port (not shown), and also defines a left cylinder port 91 and a right cylinder port (not shown).

The gerotor gear set or displacement mechanism 83 could be just like the gerotor gear set 15 in the embodiment of FIGS. 1 through 4. However, typically in SCU's, there is an internally toothed ring member 93, wherein the internal teeth thereof are formed integrally, as is well known in the art, rather than having separate rollers for internal teeth, as shown in FIG. 2. The gerotor gear set 83 also includes an externally toothed star member 95, which is disposed eccentrically within the ring member 93, for orbital and rotational movement therein, as is conventional in an SCU. As is known to those skilled in the SCU art, the gerotor gear set 83 serves as a fluid meter, such that the orbital and rotational movement of the star member 95 meters or measures the volume of fluid which is communicated through the cylinder port 91 (in the case of a left turn) to the steering cylinder (not shown).

Extending through the forward end cap 85 is an input shaft 97 which, rearward of the fluid meter 83, comprises a primary, rotatable spool valve member 99. Disposed radially between the spool valve 99 and the valve housing section 81 is a relatively rotatable, follow-up sleeve valve 101. As is also well known to those skilled in the SCU art, it is the amount of relative rotation between the spool 99 and the sleeve 101 which determines the size of the various orifices in the main flow path of the SCU, and thus, the rate of flow through the SCU, to the steering cylinder.

In an SCU, the other function of the fluid meter 83, beside measuring the fluid flow therethrough, is transmitting rotational follow-up movement to the follow-up valve member 101, until the rotatable spool 99 and sleeve 101 are again in their relative neutral positions, after the steering cylinder has been moved to the desired displacement (steering angle). The present invention enables the orbital and rotational movement of the star 95 to be translated into rotational follow-up movement of the sleeve 101 in a manner which is both compact and efficient.

The input shaft 97 defines a diametrally elongated opening 103, which is similar to the opening 69 in the embodiment of FIGS. 1 through 4. The input shaft 97 also defines a diametrally extending bore 105, which may be merely cylindrical as is the bore 71 in the embodiment of FIGS. 1 through 4. However, in any situation where the shaft is relatively small in diameter, the pin opening extending therethrough may have some shape other than merely cylindrical; for example, the opening may be generally hour-glass shaped to permit rotation of the shaft 97 and spool 99. Surrounding the input shaft 97 is a coupling member 107, having a star end 107*a* and a shaft end 107*b*. The star end 107*a* of the coupling member defines a pair of diametrically opposite notches 109, and similarly, the shaft end 107*b* of the coupling defines a pair of diametrically opposite notches 111.

Extending through the elongated opening 103 is an elongated pin 113, the ends of which extend through the notches 109, in a close fit relationship therein, and are received within openings in the star 95. Thus, the star end 107*a* of the coupling member 107 can orbit and rotate in the same manner as was described in connection with the embodiment of FIGS. 1 through 4. Extending through the bore 105 is an elongated pin 115, the ends of which are disposed within the notches 111, in a close fit relationship therein. The pin 115 differs from the pin 113, and also differs from either of the pins in the primary embodiment in that the length of the pin 115 is preferably just slightly less than the diameter of the valve bore defined by the valve housing section 81, to permit the pin 115 to rotate about the axis of the SCU.

The sleeve valve 101 includes a forward end portion 117 which includes a pair of drive tangs 119 disposed on opposite sides of each end of the pin 115. As may be seen in FIG. 5, the drive tangs 119 are disposed radially between the input shaft 97 and the shaft end 107*b* of the coupling member 107. Thus, orbital and rotational movement of the star end 107*a* becomes purely rotational movement of the shaft end 107*b*, which is transmitted into rotation of the pin 115, transmitting rotational, follow-up movement to the sleeve valve 101.

Two differences should be noted between the first embodiment (that of FIGS. 1 through 4) and the second embodiment (that of FIG. 5). In the first embodiment, the coupling member 63 is coupled to the forward end of the star 21, and then extends forwardly therefrom to drive the output shaft 29. In the second embodiment, the coupling 107 is also coupled to the forward end of the star 95, but the coupling member 107 extends rearwardly therefrom, thereby passing axially through a central opening defined by the star 95, to engage the sleeve valve 101 disposed rearwardly of the star 95. Another difference is that in the first embodiment, the elongated pins 73 and 77 are disposed 90 degrees apart, at right angles to each other. In the second embodiment, the elongated pins 113 and 115 are parallel to each other. Especially in the case of a motor, it may be desirable to offset the notches 65 and 67 by 90 degrees from each other, in order to make the coupling member 63 stronger.

FIG. 6 EMBODIMENT

Referring now primarily to FIG. 6, there is illustrated the use of an alternative embodiment of the present invention in a low speed high torque gerotor motor of somewhat different architecture or construction than that of FIG. 1. In FIG. 6, in which elements will bear reference numerals in excess of "200", there is shown a motor of the disk valve type, in accordance with above-incorporated U.S. Pat. No. 4,343,600. However, for reasons which will become apparent upon further reading, the motor in FIG. 6 looks very different from that of the incorporated patent.

It should also be noted that in FIG. 6, the "forward" end of the motor is to the left, rather than to the right as in the FIG. 1 embodiment. The motor of FIG. 6 includes a forward bearing housing 201, which rotatably supports an output shaft 203. Disposed adjacent the bearing housing 201 is a gerotor gear set, generally designated 205, including the internally toothed ring member 207, and an externally toothed star member 209.

Disposed rearwardly of the gear set 205 is a valve housing 211, including an inlet port 213 and an outlet port 215. Disposed within the housing 211 is a rotatable disk valve 217 and a balancing ring 219, both of which are generally well known to those skilled in the art.

In a manner similar to the embodiment of FIG. 1, the output shaft 203 includes a reduced diameter portion 221 which extends rearwardly through a central opening defined by the star member 209. The reduced portion 221 is rotatably supported within the valve housing 211 by means of a bearing set 223 (shown only schematically), the portion 221 then extending rearwardly out of the housing 211, thus providing a "thru-shaft" capability. As is generally well known to those skilled in the art, it is normally desirable in a thru-shaft type of gerotor motor for both shafts to be driven at the rotational speed of the star member, such that having a single, integral shaft extending both forwardly and rearwardly of the motor satisfies the majority of the through shaft motor requirements.

As should be apparent to those skilled in the art, the key feature of the present invention is the provision of a relatively shorter coupling member which is hollow, such that a shaft can extend axially through the coupling member. In the embodiment of FIG. 6, there are certain differences, as compared to the embodiment of FIG. 1. In FIG. 6, the star member 209 defines, toward its forward end, a set of straight internal splines 225, and immediately forward of the bearing set 223, the reduced diameter portion 221 includes a set of external, crowned splines 227. Surrounding the reduced diameter portion 221 is a coupling member 229. The forward end of the coupling member 229 includes a set of external, crowned splines 231, which are in engagement with the internal splines 225. The rearward end of the coupling member 229 defines a set of straight, internal splines 233, which are in engagement with the external, crowned splines 227. Thus, as the star member 209 orbits and rotates, that motion is transmitted to the forward end of the coupling member 229, while the rearward end of the coupling 229 merely rotates and transmits that rotational motion to the reduced diameter portion 221, and both the forward and rearward output shafts. Therefore, the coupling member 229 is "operatively associated with" the terminal portion 221, as that term is used in the appended claims.

Disposed axially between the splines 231 and 233, the coupling member 229 defines a pair of diametrally opposed, elongated openings 235. A pin 237 extends radially through the openings 235, and engages, at each of its opposite ends, the disk valve 217, whereby rotation of the portion 221 is transmitted to the disk valve 217, such that the disk valve 217 rotates as a "low speed" valve, as that term is well understood to those skilled in the art.

By reviewing the various embodiments of the present invention, it may be understood that the invention provides a means for transmitting orbital and rotational motion of a gerotor star to a rotating shaft in a way which provides substantial design flexibility for the designer of the motor or the SCU, etc. The rotational motion of the gerotor star may be transmitted in either a forward or rearward direction from the star, and may be transmitted to either a conventional shaft or to a valve member (in the case of an SCU) which is required to have the same rotational motion as the star. Furthermore, the translation of the orbital and rotational motion of the star is done by a hollow coupling, wherein motion can be translated from the star to the coupling, and then from the coupling to the shaft or sleeve, etc. by means of pins in notches, or engaging splines, or any other suitable and functionally equivalent means, such as a form of Oldham coupling, etc.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A rotary fluid pressure device of the type including housing means defining a fluid inlet port and a fluid outlet port, fluid energy-translating displacement means associated with said housing means and including an internally-toothed ring member and an extemally-toothed star member eccentrically disposed within said ring member, and having orbital and rotational movement relative to said ring member, the teeth of said ring member and said star member interengaging to define expanding and contracting fluid volume chambers in response to said orbital and rotational movement; valve means cooperating with said housing means to provide fluid communication between said inlet port and said expanding fluid volume chambers, and between said contracting fluid volume chambers and said outlet port; shaft means rotatably supported relative to said housing means; and means for transmitting said orbital and rotational movement of said star member into rotational movement of said shaft means; characterized by:

(a) said means for transmitting said orbital and rotational movement comprising said shaft means including a terminal portion disposed adjacent said star member;

(b) a generally cylindrical, hollow coupling member associated with said terminal portion of said shaft means, and surrounding said terminal portion of said shaft means, said coupling member including a star end and a shaft end and having its axis at a wobble angle relative to the axis of said shaft means, said shaft means being configured such that none of said shaft means surrounds said coupling member;

(c) first means coupling said star end of said coupling member to said star member to orbit and rotate therewith; and (d) second means coupling said shaft end of said coupling member to said shaft means to transmit rotational movement of said shaft end of said coupling member to said shaft means.

2. A rotary fluid pressure device as claimed in claim 1, characterized by said valve means comprises a generally cylindrical valve member, said displacement means being disposed axially between said shaft means and said valve member, said device comprising a motor, and said shaft means comprising a motor output shaft.

3. A rotary fluid pressure device as claimed in claim 2, characterized by said terminal portion of said shaft means extending through a central opening defined by said star member, said terminal portion being fixed to rotate with said valve member.

4. A rotary fluid pressure device as claimed in claim 1, characterized by said first coupling means comprising said star end of said coupling member defining a pair of notches disposed diametrally opposite each other, and a first elongated drive member in driving engagement with said star member and extending along a diameter of a central opening defined by said star member, said first elongated drive member passing through said pair of notches defined by said star end, and being closely spaced apart therein.

5. A rotary fluid pressure device as claimed in claim 4, characterized by said terminal portion of said shaft means ext ending axially into said central opening defined by said star member, said terminal portion defining a diametrally elongated opening, said first elongated drive member extending through said elongated opening permitting said star member and said first elongated drive member to orbit relative to said terminal portion.

6. A rotary fluid pressure device as claimed in claim 4, characterized by said second coupling means comprising said shaft end of said coupling member defining a pair of notches disposed diametrally opposite each other, and a second elongated drive member in driving engagement with said terminal portion of said shaft means, said second elongated drive member passing through said pair of notches defined by said shaft end, and being closely spaced apart therein.

7. A rotary fluid pressure device as claimed in claim 6, characterized by said terminal portion of said shaft means defining an opening extending along a diameter of said terminal portion, said opening receiving said second elongated drive member therein.

8. A rotary fluid pressure device as claimed in claim 1, characterized by said device comprising a power steering device including an input shaft extending through a central opening defined by said star member and said shaft means comprising a rotary follow-up valve member, said generally cylindrical, hollow coupling member surrounding said input shaft and being coupled to said follow-up member at a location disposed adjacent said star member.

9. A rotary fluid pressure device as claimed in claim 1, characterized by said first means coupling said star end of said coupling member to said star member comprising said star member defining a set of internal splines and said coupling member defining a set of crowned external splines in engagement with said internal splines.

10. A rotary fluid pressure device as claimed in claim 9, characterized by said internal splines comprising straight splines, and said external splines comprising crowned splines.

11. A rotary fluid pressure device as claimed in claim 1, characterized by said second means coupling said shaft end of said coupling member to said shaft means comprising said coupling member defining a set of internal splines, and said terminal portion of shaft means defining a set of external splines in engagement with said internal splines.

12. A rotary fluid pressure device as claimed in claim 11, characterized by said internal splines comprising straight splines, and said external splines comprising crowned splines.

13. A rotary fluid pressure device of the type including housing means defining a fluid inlet port and a fluid outlet port, fluid energy-translating displacement means associated with said housing means and including an internally-toothed ring member and an externally-toothed star member eccentrically disposed within said ring member, and having orbital and rotational movement relative to said ring member, the teeth of said ring member and said star member interengaging to define expanding and contracting fluid volume chambers in response to said orbital and rotational movement; valve means cooperating with said housing means to provide fluid communication between said inlet port and said expanding fluid volume chambers, and between said contracting fluid volume chambers and said outlet port; shaft means rotatably supported relative to said housing means; and means for transmitting said orbital and rotational movement of said star member into rotational movement of said shaft means; characterized by:

(a) said means for transmitting said orbital and rotational movement comprising said shaft means including a terminal portion disposed adjacent said star member, said terminal portion of said shaft means extending through a central opening defined by said star member, said terminal portion being fixed to rotate with said valve means;

(b) a generally cylindrical, hollow coupling member associated with said terminal portion of said shaft means, said coupling member including a star end and a shaft end and having its axis at a wobble angle relative to the axis of said shaft means, said shaft means being configured such that none of said shaft means surrounds said coupling member;

(c) first means coupling said star end of said coupling member to said star member to orbit and rotate therewith; and (d) second means coupling said shaft end of said coupling member to said shaft means to transmit rotational movement of said shaft end of said coupling member to said shaft means.

14. A rotary fluid pressure device as claimed in claim 13, characterized by said valve means comprises a generally cylindrical valve member, said displacement means being disposed axially between said shaft means and said valve member, said device comprising a motor, and said shaft means comprising a motor output shaft.

15. A rotary fluid pressure device of the type including housing means defining a fluid inlet port and a fluid outlet port, fluid energy-translating displacement means associated with said housing means and including an internally-toothed ring member and an externally-toothed star member eccentrically disposed within said ring member, and having orbital and rotational movement relative to said ring member, the teeth of said ring member and said star member interengaging to define expanding and contracting fluid volume chambers in response to said orbital and rotational movement; valve means cooperating with said housing means to provide fluid communication between said inlet port and said expanding fluid volume chambers, and between said contracting fluid volume chambers and said outlet port; shaft means rotatably supported relative to said housing means; and means for transmitting said orbital and rotational movement of said star member into rotational movement of said shaft means; characterized by:

(a) said means for transmitting said orbital and rotational movement comprising said shaft means including a terminal portion disposed adjacent said star member;

(b) a generally cylindrical, hollow coupling member associated with said terminal portion of said shaft means, and surrounding said terminal portion of said shaft means, said coupling member including a star end and a shaft end and having its axis at a wobble angle relative to the axis of said shaft means;

(c) first means coupling said star end of said coupling member to said star member to orbit and rotate therewith; and (d) second means coupling said shaft end of said coupling member to a portion of said shaft means disposed within said coupling member to transmit rotational movement of said shaft end of said coupling member to said shaft means.

* * * * *